United States Patent [19]

Weimar

[11] Patent Number: 4,799,680

[45] Date of Patent: Jan. 24, 1989

[54] TRANSPARENT PUZZLE

[76] Inventor: Deborah M. Weimar, 25 Macopin Ave., Upper Montclair, N.J. 07043

[21] Appl. No.: 121,936

[22] Filed: Nov. 18, 1987

[51] Int. Cl.[4] ..... A63F 9/10; G09B 11/06

[52] U.S. Cl. ..... 273/157 R; 273/157 A; 434/81; 434/88; 434/96

[58] Field of Search ..... 273/157 R, 157 A; 434/81, 84, 88, 96

[56] References Cited

U.S. PATENT DOCUMENTS

| | | | |
|---|---|---|---|
| 2,149,779 | 3/1939 | Kroner | 273/157 A X |
| 2,280,609 | 4/1942 | Williamson | 273/157 R |
| 2,328,281 | 8/1943 | Jones | 273/157 R X |
| 2,556,798 | 6/1951 | Concordet | 273/157 A X |
| 2,954,616 | 10/1960 | Mogard | 273/157 R X |
| 3,107,918 | 10/1963 | Edlen | 273/157 A X |
| 3,419,971 | 1/1969 | Ribken | 273/157 A X |
| 3,588,115 | 6/1971 | Nichols | 273/157 A X |
| 3,637,217 | 1/1972 | Kent | 273/157 R |
| 3,775,153 | 11/1973 | Greenberg et al. | 273/157 R X |
| 4,302,013 | 11/1981 | Kavis | 273/157 R |
| 4,486,018 | 12/1984 | Keller, Jr. | 273/157 R |

FOREIGN PATENT DOCUMENTS

| | | | |
|---|---|---|---|
| 3502581 | 5/1986 | Fed. Rep. of Germany . | |
| 1576436 | 12/1969 | France | 273/157 R |
| 621701 | 4/1949 | United Kingdom | 273/157 A |

OTHER PUBLICATIONS

Sketch-A-Puzzle, Early Childhood Catalog, received May 28, 1986, p. 41.

*Primary Examiner*—Anton O. Oechsle

*Attorney, Agent, or Firm*—Anthony J. Casella; Gerald E. Hespos

[57] ABSTRACT

A puzzle is provided comprising a base formed from a transparent material and including a generally planar bottom wall and a frame extending upwardly from the bottom wall to define a puzzle recess. The puzzle further comprises a plurality of transparent puzzle pieces dimensioned to be received within the puzzle recess of the base. The transparent puzzle pieces are formed from a material that removably accepts markings thereon. The puzzle can be used by placing the base and the assembled puzzle pieces over a selected image which can be traced with a suitable marker. The puzzle pieces with the traced image thereon can be removed from the base and subsequently reassembled. The image created on the puzzle pieces can further be removed therefrom to enable the creation of a new puzzle.

18 Claims, 2 Drawing Sheets

TRANSPARENT PUZZLE

BACKGROUND OF THE INVENTION

Jigsaw puzzles are widely used for recreational purposes by people of all ages. The number, size and shape of the pieces in jigsaw puzzles, as well as the indicia disposed on individual pieces, varies widely depending upon the age and skill of the person for whom the puzzle is intended.

Puzzles also can be an educational tool for children. In particular, puzzles require the child to think, stimulate the child's interest, develop the child's attention span, contribute to the development of motor control, help the child to understand spatial relationships and part/whole relationships, to develop hand/eye coordination and to understand and test hypotheses. The puzzle may further contribute to other educational objectives depending upon the particular indicia presented on the puzzle pieces. For example, puzzles have been developed with pieces resembling letters, numbers, locations on a map and such.

Prior art puzzles geared toward children, however, have exhibited certain deficiencies. For example, a child typically will memorize the puzzle design very quickly, and thus will be able to complete the puzzle by rote after a short period of time. This rote solution to the prior art puzzle will be based on the shapes of the puzzle pieces, with little attention being given to the indicia printed thereon. Typically, the child will become bored with the puzzle after the solution has been memorized, and the puzzle will thus fall into disuse.

Another deficiency of available puzzles for children is that the puzzles often will not match the child's cognitive level, or will match the child's cognitive level for only a short period of time. Thus, the child will rapidly outgrow the puzzle, and will want puzzles with smaller pieces, more complex indicia and such to stimulate his or her interest. If the puzzle is too easy the child will become bored, while if the puzzle is too complex the child may become frustrated. The importance and difficulty of matching a child's cognitive level and drawing on things within a child's cognitive experience as part of any learning exercise is treated in the well known teachings of Jean Piaget.

Another seemingly unavoidable deficiency of known puzzles is the inevitable tendency of children to lose puzzle pieces. A particular odd-shaped puzzle piece is often difficult or impossible to replace, thereby rendering the entire puzzle useless or unappealing.

Various attempts have been made to provide puzzles with increased appeal and/or increased educational value for children. For example, one recent puzzle includes a plurality of laminated paper pieces of irregular shape and adapted to fit within a frame. The uppermost layer is a glossy white paper which will removably accept the markings of a grease pencil. The child may thus create his or her own puzzle by drawing a selected design or picture on the glossy white top layer of the puzzle pieces with the grease pencil. This particular prior art puzzle also has certain deficiencies. First, young children may not have a sufficiently developed artistic ability to create a puzzle design that will stimulate their own interest. Thus, the child's own art work will often be below his or her cognitive level. Second, as noted above, the child will typically learn to solve a puzzle based on the particular arrangement of puzzle pieces. Thus, the child will be able to readily solve the puzzle with little attention being paid to the indicia they created, and in fact the child may learn to solve the puzzle with no indicia. These puzzles also have been limited to the particular grease pencil or crayon sold therewith. The young child will often want to experiment with other writing implements, and may create an indelible image on the pieces to effectively ruin the puzzle. In addition to the above described specific deficiencies, pieces are apt to be irreplaceably lost, and the child will outgrow the puzzle, as would be the case with any other traditional puzzle.

The prior art includes many other attempts to enhance the challenge and/or enjoyment of puzzles. For example, U.S. Pat. No. 2,954,616 which issued to Mogard on Oct. 4, 1960 shows a puzzle having an opaque base and an opaque sheet that can be inserted into the base. The opaque sheet includes various indicia, such as street signs or the like. The puzzle of U.S. Pat. No. 2,945,616 further includes a plurality of pieces bearing indicia which in some way corresponds to the indicia on the sheet of material slid into the base. This puzzle is intended to function as a teaching aid by requiring an association to be made between the puzzle piece and the corresponding indicia on the sheet. In certain embodiments, the puzzle of U.S. Pat. No. 2,954,616 includes a transparent cover sheet that can be slid into the base to retain the puzzle pieces in their assembled condition.

U.S. Pat. No. 4,302,013 and U.S. Pat. No. 4,486,018 each show cases having transparent covers for storing jigsaw puzzles in various stages of completion.

U.S. Pat. No. 3,419,971 issued to Ribken on Jan. 7, 1969, and is directed to a tracing game with various overlays that are mountable on a board to create a composite image.

U.S. Pat. No. 2,280,609 issued to Williamson on Apr. 21, 1942 and shows the use of various indicia-bearing square pieces that can be assembled to either create or complete a puzzle.

This prior art generally does not provide adequate levels of recreational, educational and developmental activity simultaneously.

In view of the above, it is an object of the subject invention to provide a puzzle with enhanced ability and versatility as a learning tool for children, and that will match the child's cognitive level and will enable the child to draw on and employ things already in his or her cognitive repertoire.

It is another object of the subject invention to provide a versatile puzzle that can be used with other media to attract the child's attention to the other media and to the puzzle and to simultaneously develop various learning skills.

An additional object of the subject invention is to provide a puzzle that enables the child to develop their own puzzle designs and representations either by tracing or by creating their own design or picture.

Still another object of the subject invention is to provide a puzzle that can be used to create a three-dimensional puzzle design for use by visually impaired children or children who require additional hand/eye coordination development.

Yet another object of the subject invention is to provide a puzzle that will removably receive any of a broad variety of means for creating two or three-dimensional indicia.

A further object of the subject invention is to provide a puzzle that is durable and that is particularly well adapted to accept replacement pieces.

It is a further object of the subject invention to provide a puzzle that can be rendered more challenging for a child as the child grows older.

SUMMARY OF THE INVENTION

The subject invention is directed to a puzzle having a transparent base and a plurality of transparent pieces removably mounted in the base. The puzzle may further comprise a transparent cover mountable to the base to hold the puzzle pieces in position for storage or display. The puzzle pieces are dimensioned to achieve a loose fit in the base to enable easy removal by a child. At least one piece on the base may include a cut out to facilitate removal of the first piece. The puzzle pieces and preferably the base are formed from a material that can removably receive indicia or marking means thereon. For example, the puzzle pieces and base may removably accept the markings of felt tip pens employing water soluble ink or dye, grease pencils, wax based crayons or other marking means as explained further herein that provide a substantially two-dimensional removable image. Preferably, the puzzle pieces enable the two-dimensional indicia to be readily removed with a slightly moistened cloth. Additionally, the puzzle pieces may be formed from a material that is washable to further facilitate the removal of indicia or soil thereon, and to provide for enhanced hygiene in classroom applications.

The puzzle pieces may further be formed from a material that accepts a three-dimensional marking medium such as white glue, rubber cement, clay and such. These three-dimensional marking media provide many additional options for puzzle making and can be used to further enhance the development of the sense of touch, and hand/eye coordination. Additionally, the three-dimensional marking media enable the development of puzzles to be used by children with visual impairment. Furthermore, the three-dimensional marking media can be employed with the puzzle pieces and with other objects which may be temporarily adhered to the puzzle pieces to create more complex three-dimensional puzzles. These other objects that may be temporarily adhered to the puzzle pieces may include paper, felt swatches, sticks, beads, glitter and yarn, to name a few.

The puzzle of the subject invention may be employed by initially placing the transparent puzzle pieces in their assembled condition in the transparent base. The assembled transparent puzzle pieces and the transparent base may then be placed on an illustration in a book, a photograph, or the like, and the child may trace the illustration disposed beneath the base onto the assembled puzzle pieces. Thus, the child is employing the puzzle with a book, poster or the like that is already within his or her cognitive repertoire and with which he or she has an interest. Furthermore, this tracing generally will not exceed the child's artistic abilities. The entire puzzle with the traced indicia thereon may then be disassembled and the base removed from the illustration that had been traced. The child may then reassemble the puzzle pieces with the indicia thereon to recreate the illustration that previously had been traced. This puzzle may be repeatedly disassembled and reassembled. Furthermore, the markings on the puzzle pieces can readily be removed therefrom to enable the child to trace a new illustration and thereby create a new puzzle. The ability to trace from previously printed material effectively develops an interest in the book, picture or the like. Thus, the puzzle can enable the learning experiences associated with a book to be combined in an enjoyable manner with the development of hand/eye coordination, motor skills, spatial relationships, part/whole relationships and other such skills associated with puzzles, as explained above.

The puzzle further enables the child to trace a three-dimensional object or scene spaced from the puzzle. In particular, the assembled transparent puzzle pieces and the transparent base may be held in a substantially upright position between the child and a three-dimensional object or scene to be drawn or traced on the puzzle pieces. This creates an entirely new dimension to puzzle making, and teaches the child various skills associated with sketching, painting and other pictorial representations.

The puzzle may further be used to create a unique puzzle design independent of any tracing activity. Thus, a reasonably advanced child can simply draw a design or picture onto the puzzle pieces to create his or her own puzzle.

All of the above options for using the subject puzzle can be carried out in a supervised environment, such as a school, to contribute to the child's formal education. For example, the child could create various combinations of letters, numbers and illustrations. In particular, the underlying sheet may depict an apple and a ball. The child could then be requested to trace the apple and the ball and to write the letter "a" under the traced apple and "b" under the traced ball. The transparent puzzle pieces could then be disassembled and reassembled to reinforce this learning exercise. Alternatively, a teacher or child could draw or trace an image on the transparent base and the child could add to that image on the puzzle pieces to yield a puzzle that must be assembled to match the underlying image on the base. For example, the image on the base could be a bare landscape. The child could then add to that image with indicia on the puzzle pieces identifying a particular season (e.g. leaves and flowers for spring, snowmen and sleds for winter and appropriate colors throughout). The seasonal puzzle could be changed by merely cleaning the puzzle pieces and adding new seasonal indicia. The puzzle also could be incorporated into group activities. Other activities would use paint brushes and water to alter designs made with was based, water soluble, high pigment crayons. In other situations finger paint or poster paint could be used to create the puzzle. In other options, the transparent characteristics of the base, pieces and cover enable the puzzle to be used with a light source to create interesting visual effects and to show the effect of light on the variously colored puzzle pieces. The puzzle could also be used to create and teach the concept of depth, by selectively placing indicia on either side of the transparent base, the transparent puzzle pieces and the transparent cover, which could be placed either on top of or beneath the base. A host of other learning exercises could of course be developed by the experienced educator. With all of these options, the ability to trace through and/or onto the transparent base, the transparent puzzle pieces and the transparent cover ensures that children will develop puzzles within their cognitive repertoire and of interest to them. Thus, each child's motivational level will be high and the child is more likely to learn about other aspects of problem solving.

The puzzle pieces may be of any desired shape. However, in a preferred embodiment the puzzle pieces are all square. These square puzzle pieces may be dimensioned to fit within a square frame. This greatly facilitates the ability to provide replacement pieces, since all pieces are the same shape. Furthermore, this avoids the tendency of children to learn puzzles by the shapes independent of the indicia thereon. Additionally, the puzzle can readily be upgraded to different degrees of complexity by providing a greater number of square pieces. Thus, the simplest puzzle may consist of four square transparent pieces disposed in a two-by-two array within the square opening of the transparent base. The same transparent base could be used with nine square transparent puzzle pieces dimensioned to create a three-by-three array. Appropriately smaller puzzle pieces enable more complex arrays to be incorporated into the initial transparent base.

DETAILED DESCRIPTION OF THE PREFERRED EMBODIMENT

Figure 1:
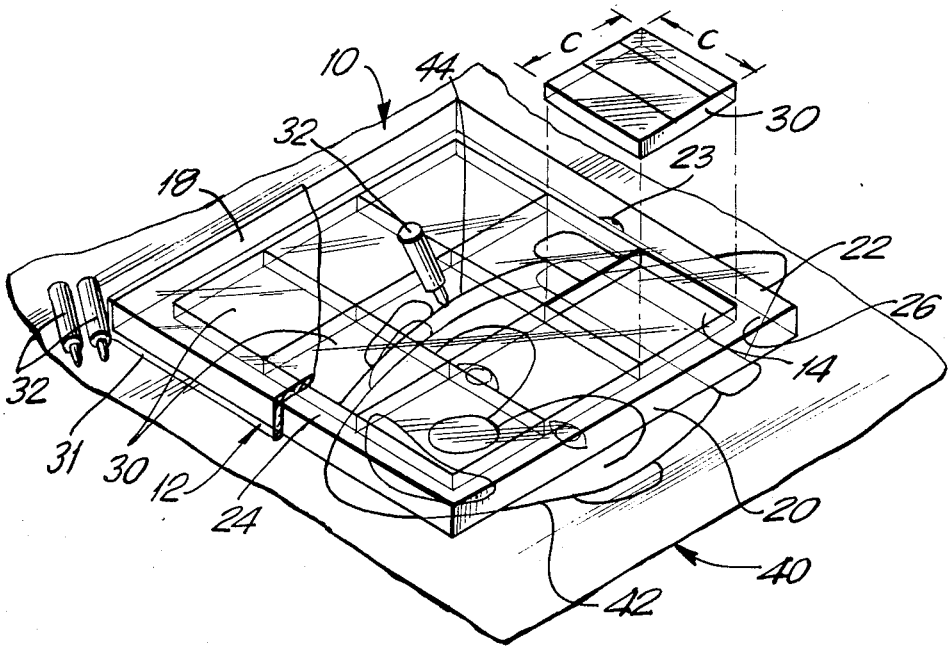
FIG. 1 is an exploded perspective view of the puzzle of the subject invention.
Figure 2:
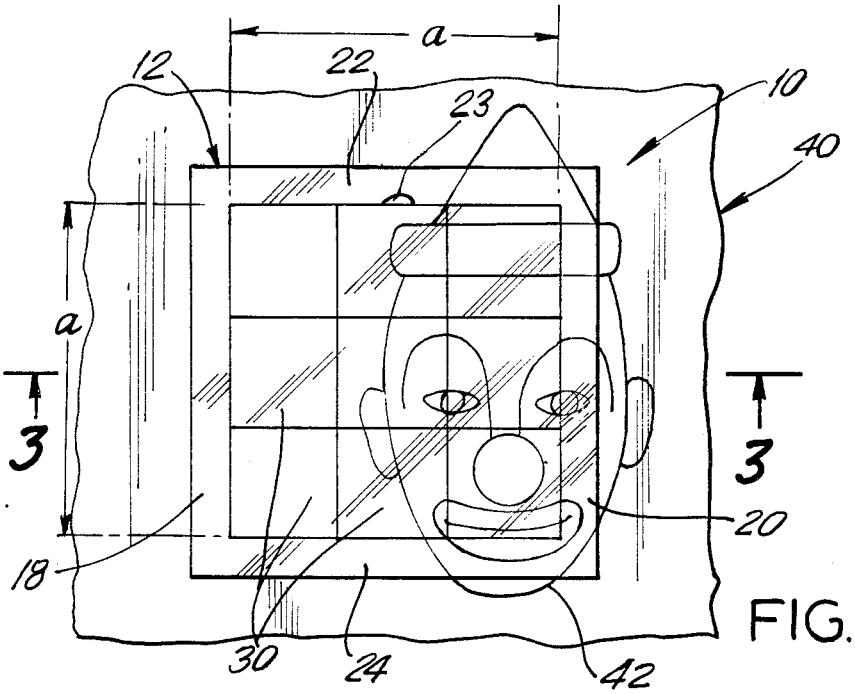
FIG. 2 is a top plan view of the puzzle of the subject invention.
Figure 3:
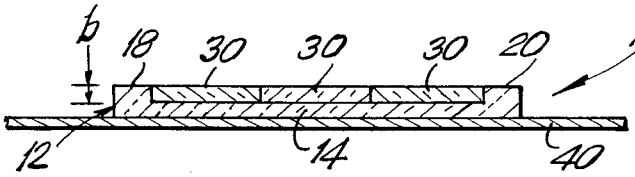
FIG. 3 is a cross-sectional view taken along line 3—3 in FIG. 2.

The puzzle of the subject invention is indicated generally by the number 10 in FIGS. 1–3. The puzzle 10 comprises a base 12 having a generally planar bottom wall 14. The base 12 is further defined by a pair of opposed parallel side walls 18 and 20 and a pair of opposed parallel end walls 22 and 24. More particularly, the side walls 18 and 20 and end walls 22 and 24 extend upwardly from the bottom wall 14 to define a frame with a square puzzle recess 26 having a length "a" and a width "a". The actual distances defined by dimensions "a" can vary widely, but typically will be selected to enable a child to readily handle the puzzle 10 and to facilitate carrying and storage of the puzzle 10 by a child. Typically, the dimension "a" will be in the range of 6 inches to 18 inches. The frame 16 defines a depth of "b" extending away from the planar bottom surface 14. Typically, the dimension "b" will equal between $\frac{1}{8}$ inch and $\frac{1}{4}$ inch. The side 22 of base 12 includes a cut out 23 to facilitate removal of the puzzle pieces. More than one cut out may be provided, including a cut out in the bottom wall 14 or in a puzzle piece.

The base 12 of the puzzle 10 is formed from a transparent material, and preferably a lightweight plastic transparent material that is not subject to breaking. For example, the base 12 may be formed from a Lucite® which exhibits both a high degree of transparency, adequate strength and durability and a hard substantially impervious finish that is easily cleaned, as explained further below. The entire base 12 preferably is formed by molding from a unitary piece of the plastic material to be free of sharp edges. However, the base 12 may be formed from a plurality of separate pieces connected to one another to define an integral member. For example, the bottom wall 14 may be formed from a unitary piece of plastic, while the respective side walls 18 and 20 and the end walls 22 and 24 are formed from separate plastic members which are mitered to fit together to define the square puzzle recess 26, and which are glued to one another and to the bottom wall 14 to define an integral base 12 as depicted in FIGS. 1–3.

The puzzle 10 further comprises a plurality of substantially square planar puzzle pieces 30. The puzzle pieces 30 also are formed from a transparent material, and preferably a molded transparent plastic material such as Lucite® which has no sharp edges or corners. As noted above, the Lucite® is substantially unbreakable, and exhibits a high degree of transparency. Furthermore, the Lucite® has been found to be substantially impervious to a wide range of markings that may be placed thereon. Consequently, the markings are easily removed from pieces 30. Each puzzle piece 30 has a thickness "b" substantially equal to the distance "b" by which the frame 16 extends from the planar bottom surface 14 of base 12. Thus, when the puzzle pieces 30 are placed in the recess 26 as depicted in FIGS. 1–3, the puzzle piece 30 will be substantially flush with the frame 16. One side of each puzzle piece ay be non-planar to provide a directional orientation for the puzzle pieces 30.

The puzzle pieces 30 define substantially identical squares having side dimensions "c". The dimension "c" approximately equals the quotient achieved by dividing a selected whole number greater than 1 into the dimension "a" defining a side of the puzzle recess 26 in the base 12. Thus, as depicted in FIGS. 1 and 2, the dimension "c" approximately equals $\frac{1}{3}$ of the dimension "a". In this instance, the selected divisor equals 3. Furthermore, the puzzle 10 is characterized by the fact that the number of puzzle pieces 30 is equal to the square of the selected divisor. Thus, the puzzle 10 depicted in FIGS. 1–3 has a total of $3^2$ or nine puzzle pieces. A simpler puzzle would have each puzzle piece with a dimension equal to $\frac{1}{2}$ the dimension "a". In this example, the selected divisor is "2" and the puzzle would have $2^2$ or four puzzle pieces. In each instance the dimension "c" is selected to achieve a loose fit of pieces 30 in base 12 to facilitate removal by a child. Thus, "c" multiplied by the selected divisor may be $\frac{1}{8}$ inch to $\frac{1}{4}$ inch less than dimension "a".

The puzzle 10 further comprises a transparent plastic cover 31 which telescopingly engages the base 12 from either the top or bottom, and retains the puzzle pieces 30 therein when placed over the top of base 12. The cover 31 preferably is molded from the same plastic as the base 12.

Figure 4:
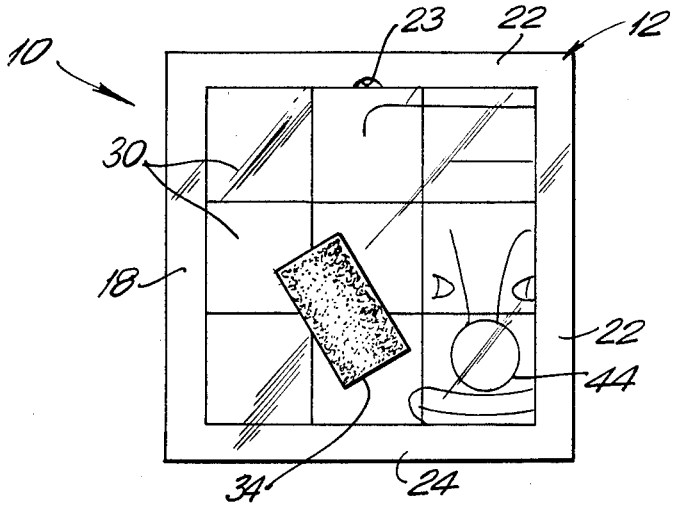
FIG. 4 is a top plan view of the puzzle of FIG. 2 in combination with a means for removing the indicia thereon.

The puzzle 10 is employed with at least one dye dispensing means, such as marker 32 which is capable of removably placing water soluble indicia upon the puzzle pieces 30. The range of available markers will depend in part upon the specific transparent plastic material selected for pieces 30. For example, it has been determined that for puzzle pieces 30 formed from Lucite®, most felt tip pens with water soluble dye create a distinct image on the puzzle pieces 30 with little if any running or beading of the marking medium. In addition to the desired water solubility, the marking medium should be fast drying and should have a surface tension compatible with the selected plastic. The Chartpak AV8WF marker has performed well. However, the indicia placed on the puzzle pieces 30 by the marker 32 can readily be removed therefrom by rubbing the puzzle piece 30 with a sponge 34 or a moist cloth, paper towel or the like as shown in FIG. 4.

The puzzle 10 comprising the base 12 and the plurality of puzzle pieces 30 can be placed upon a sheet 40 having a selected original image 42 presented thereon. The original image 42 will be readily visible through both the transparent base 12 and the transparent puzzle pieces 30. As a result, the child using the puzzle 10 can trace the original image 42 using the markers 32 to create a traced image 44. The puzzle 10 can then be removed from the sheet 40 and placed on another supporting surface. The pieces 30 can be removed from the base 12, rearranged, and subsequently reassembled to recreate the traced image 44.

After the child has tired of doing the puzzle 10 with the traced image 44 thereon, the traced image 44 can be removed from the puzzle pieces 30 by the wet sponge 34 or the like. A wet cloth or paper towel are equally efficient for removing the traced image 44 from the puzzle pieces 30. Similarly, the puzzle pieces 30 can be immersed in a fluid such as water or soapy water to enable the puzzle pieces 30 to be thoroughly washed, or the entire puzzle and base can be placed in a dishwasher.

Figure 5:
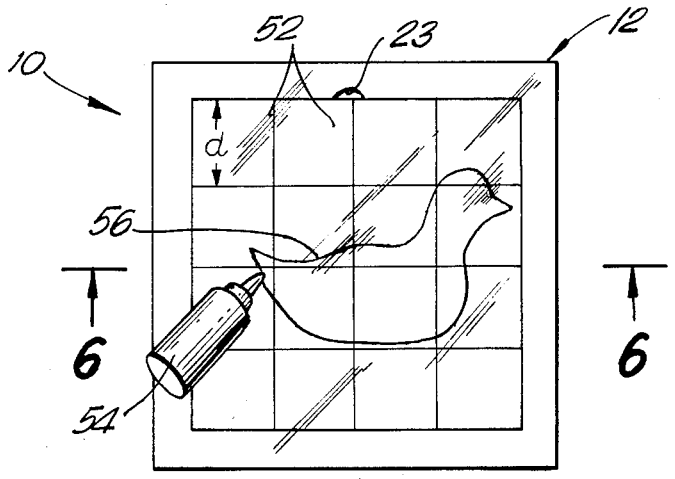
FIG. 5 is a top plan view of the transparent puzzle and transparent base used in combination with a three-dimensional marking means.
Figure 6:
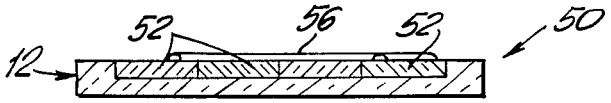
FIG. 6 is a cross-sectional view taken along line 6—6 in FIG. 5.
Figure 7:
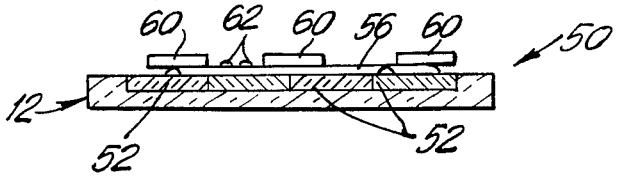
FIG. 7 is a cross-sectional view similar to FIG. 6 but showing additional objects affixed to the three-dimensional markings on the transparent puzzle pieces.

An alternate puzzle 50 is shown in FIGS. 5–7. The puzzle 50 comprises the base 12 depicted in FIGS. 1–4. However, the nine puzzle pieces 30 depicted in FIGS. 1–4 have been replaced by sixteen square planar transparent puzzle pieces 52 each of which has a side dimension "d". The dimension "d" is selected to equal ¼ the dimension "a" defining the puzzle recess 26 in base 12, thus the selected divisor is four.

The puzzle 50 is depicted in combination with an applicator 54 for dispensing a water soluble glue 56 defining an elongated bead on the surface of selected puzzle pieces 52. The water soluble glue bead 56 is used to create a selected image on the puzzle pieces 52. The particular image may be traced in the manner described with respect to FIGS. 1–4, by placing the base 12 and puzzle pieces 52 over a sheet with the desired image thereon. Alternatively, the child employing the puzzle 50 may create its own image with the water soluble glue 56 independent of any underlying material to be traced. The water soluble glue bead 56 defining the image on the puzzle pieces 52 will retain its adhesive characteristics throughout a substantial portion of its curing time. After the water soluble glue bead 56 has cured, the respective puzzle pieces 52 may merely be separated from one another, and the puzzle may subsequently be disassembled and reassembled as described above. The bead 56 defining the image on the puzzle pieces 52 can readily be removed by washing or the like. The optional use of the puzzle as depicted in FIGS. 5 and 6 provides a puzzle which can require a child to employ the sense of touch at least partly in place of the sense of sight. As a result, the puzzle can be used by visually impaired children and can enhance the teaching value of the puzzle for these students.

Another optional use of the puzzle 50 involves the use of additional material such as paper swatches 60 and glitter flakes 62 which may be applied to the image formed by glue bead 56 prior to curing. The creation of the puzzle 50 can thus be expanded into a more complex artistic endeavor. For example, the student could initially trace the image of a bird onto the puzzle pieces 52 with the glue dispenser 54, and then could subsequently adhere swatches of paper 60, glitter 62 or the like to the glue bead 56 to adorn the traced bird with feathers, color or the like. Thus, the exercise of developing the puzzle goes far beyond the initial tracing, and allows the child to express his or her own creativity to enhance the initial traced image. Furthermore, as noted above, the initial design of the glue bead 56 as well as the application of swatches 60, glitter 62 and such can be done entirely independently of any underlying image.

In summary, a puzzle is provided comprising a transparent base having a generally planar bottom wall and a plurality of upstanding side and end walls defining a puzzle recess. The base preferably is molded from an integral piece of transparent plastic material. The puzzle further comprises a plurality of generally planar transparent puzzle pieces which are dimensioned to be received within the puzzle recess defined by the transparent base. The puzzle pieces are formed from a transparent plastic material that facilitates the removable application of indicia to enable a child to create a puzzle by placing the assembled puzzle and base over a selected image and tracing that image onto the puzzle pieces with appropriate markers. The puzzle may further comprise at least one marker for applying indicia to the puzzle pieces and may further comprise means for removing indicia marked on the puzzle pieces.

While the invention has been described with respect to certain preferred embodiments, it is apparent that various changes can be made without departing from the scope of the invention as defined by the appended claims.

What is claimed is:

1. A child's puzzle comprising: a plurality of puzzle pieces formed from a transparent plastic material substantially free of any puzzle indicia permanently disposed thereon; a base defining a puzzle recess dimensioned to receive the transparent puzzle pieces, said base being defined by a bottom wall formed from a transparent plastic material substantially free of any puzzle indicia permanently disposed thereon, and a frame connected to and extending from the bottom wall; and means for removably placing indicia on the puzzle pieces and on the bottom wall of the base, whereby the child can place the puzzle in proximity to an illustration within the child's cognitive repertoire, and trace a puzzle therefrom using the means for removably placing indicia thereon.

2. A puzzle as in claim 1 wherein the frame of the base is formed from a transparent material.

3. A puzzle as in claim 2 wherein the base is of unitary construction.

4. A puzzle as in claim 1 wherein the base is formed from a transparent plastic material.

5. A puzzle as in claim 1 further comprising means for removably placing indicia on the puzzle pieces.

6. A puzzle as in claim 1 wherein the means for placing indicia on the puzzle pieces comprises at least one felt tip pen.

7. A puzzle as in claim 1 wherein the means for placing indicia on the puzzle pieces comprises a means for dispensing a dye.

8. A puzzle as in claim 1 wherein the means for placing indicia comprises a glue applicator.

9. A puzzle as in claim 1 further comprising means for removing the indicia from the puzzle pieces.

10. A puzzle as in claim 1 wherein the puzzle recess is rectangular and wherein each of said puzzle pieces is rectangular.

11. A puzzle as in claim 1 wherein the puzzle recess is substantially square, and wherein each of said puzzle pieces is substantially square.

12. A puzzle as in claim 11 comprising a first plurality of substantially identical square puzzle pieces dimensioned to be received in the puzzle recess and a second plurality of substantially identical square puzzle pieces dimensioned to be received in the puzzle recess, the puzzle pieces of said first plurality being of different dimension than the puzzle pieces of the second plurality.

13. A puzzle as in claim 1 further comprising a transparent cover removably engageable with said base to retain the puzzle pieces therein.

14. A puzzle comprising:

a transparent base formed from a unitary piece of plastic material, said base comprising a generally planar bottom wall, a pair of parallel upstanding side walls connected to and extending from said bottom wall and a pair of opposed parallel end walls connected to and extending from said bottom wall such that said bottom wall and said side and end walls define a puzzle recess having equal side and end dimensions of a selected unit length; and a plurality of square transparent plastic puzzle pieces, each said puzzle piece having a side dimension equal in length to the quotient of the selected unit length for said puzzle recess divided by a selected whole number divisor, said plurality of puzzle pieces being equal in number to the square of said selected divisor.

15. A puzzle as in claim 14 wherein said puzzle pieces and said base are formed from the same transparent plastic material.

16. A puzzle as in claim 14 further comprising means for removably placing indicia on said puzzle pieces.

17. A puzzle comprising: a plurality of transparent puzzle pieces; a base defining a puzzle recess dimensioned to receive the transparent puzzle pieces and a glue applicator means for removably placing glue on the puzzle pieces to define indicia thereon.

18. A puzzle comprising: a base defining a square puzzle recess; a first plurality of substantially identical square transparent puzzle pieces dimensioned to be received in the puzzle recess; and a second plurality of substantially identical square puzzle pieces dimensioned to be received in the puzzle recess, the puzzle pieces of said first plurality being of different dimensions than the puzzle pieces of the second plurality.

* * * * *